US009523488B2

(12) United States Patent
Le et al.

(10) Patent No.: US 9,523,488 B2
(45) Date of Patent: Dec. 20, 2016

(54) LED LAMP

(75) Inventors: Long Larry Le, Morrisville, NC (US); Curt Progl, Raleigh, NC (US)

(73) Assignee: Cree, Inc., Durham, NC (US)

( * ) Notice: Subject to any disclaimer, the term of this patent is extended or adjusted under 35 U.S.C. 154(b) by 256 days.

(21) Appl. No.: 12/889,719

(22) Filed: Sep. 24, 2010

(65) Prior Publication Data

US 2012/0075833 A1 Mar. 29, 2012

(51) Int. Cl.

| | |
|---|---|
| ***F21V 29/15*** | (2015.01) |
| *F21K 99/00* | (2016.01) |
| *F21Y 101/02* | (2006.01) |
| *F21Y 113/00* | (2016.01) |
| *F21V 3/04* | (2006.01) |

(52) U.S. Cl.

CPC ..... *F21V 29/15* (2015.01); *F21K 9/1355* (2013.01); *F21K 9/56* (2013.01); *F21V 3/0481* (2013.01); *F21Y 2101/02* (2013.01); *F21Y 2113/005* (2013.01)

(58) Field of Classification Search

CPC ..... F21V 29/15
USPC ..... 362/373, 294, 264, 249.01, 249.02
See application file for complete search history.

(56) References Cited

U.S. PATENT DOCUMENTS

| | | | | |
|---|---|---|---|---|
| 6,948,829 | B2 * | 9/2005 | Verdes et al. | 362/227 |
| 7,588,351 | B2 * | 9/2009 | Meyer | 362/294 |
| 7,663,315 | B1 | 2/2010 | Hulse | |
| 7,686,478 | B1 | 3/2010 | Hulse et al. | |
| 7,965,023 | B1 | 6/2011 | Liang | |
| 8,282,249 | B2 | 10/2012 | Liang et al. | |
| 8,427,037 | B2 | 4/2013 | Liang et al. | |
| 8,556,465 | B2 | 10/2013 | Lee et al. | |
| 2009/0213595 | A1 * | 8/2009 | Alexander et al. | 362/373 |

FOREIGN PATENT DOCUMENTS

| | | | |
|---|---|---|---|
| CN | 201344406 | Y | 11/2009 |
| CN | 101809365 | A | 8/2010 |

(Continued)

OTHER PUBLICATIONS

Cree, Inc., International Application No. PCT/US2011/026792, International Search Report and Written Opinion, May 2, 2011, 10 pages.

(Continued)

*Primary Examiner* — Julie Bannan
(74) *Attorney, Agent, or Firm* — Steven B. Phillips; Moore & Van Allen PLLC

(57) ABSTRACT

A thermal isolation arrangement for an LED lamp is disclosed. Embodiments of the invention provide thermal isolation between the power supply and the LED assembly of an LED lamp, in most cases allowing the power supply to operate in a lower temperature range than would otherwise be possible. At least one contact feature is provided between the power supply and the LED assembly to maintain a thermal transfer gap between the power supply and the LED assembly. A contact feature can be, for example, a triangular ridge or a conical protrusion. In some embodiments, a thermal isolation device provides the contact feature or contact features. An LED lamp according to example embodiments of the invention can have a modular design and/or can include an Edison base and/or an optical element or optical elements disposed to emit light from the LED lamp.

26 Claims, 8 Drawing Sheets

(56) References Cited

FOREIGN PATENT DOCUMENTS

| | | | |
|---|---|---|---|
| DE | 202008013667 | U1 | 12/2008 |
| DE | 102009014526 | A1 | 9/2010 |
| JP | 2008-159341 | A | 7/2008 |
| WO | WO 85/04769 | A1 | 10/1985 |
| WO | 0219303 | A1 | 3/2002 |
| WO | WO2009/080046 | A1 | 7/2009 |
| WO | 2010100289 | A1 | 9/2010 |

OTHER PUBLICATIONS

U.S. Federal Highway Administration, Manual on Uniform Traffic Control Devices for Streets and Highways, 2009 Edition, Including Revision 1 dated May 2012 and Revision 2 dated May 2012.
Chinese Patent Office; Office Action for Chinese Application No. 201180053514.8 dated Aug. 18, 2015, 7 Pages.
Cree, Inc., Chinese Patent Application No. 201180053514.8, Third Office Action, Mar. 11, 2016.
Chinese Patent Office, Chid Patent Application No. 201180053514.8, Office Action dated Jan. 7, 2015, 12 pages.
Taiwan Intellectual Property Office, Taiwan Patent Application No. 100106967 Office Action dated May 9, 2014, pp. 1-12.
German Patent Office, German Patent Application No. 11 2011 103 188.2 Office Action dated Jun. 18, 2014, pp. 1-12.

* cited by examiner

LED LAMP

BACKGROUND

Light emitting diode (LED) lighting systems are becoming more prevalent as replacements for existing lighting systems. LEDs are an example of solid state lighting and have advantages over traditional lighting solutions such as incandescent and fluorescent lighting because they use less energy, are more durable, operate longer, can be combined in red-blue-green arrays that can be controlled to deliver virtually any color light, and contain no lead or mercury.

In many applications, one or more LED dies (or chips) are mounted within an LED package or on an LED module, which may make up part of a lighting unit, lamp, "light bulb" or more simply a "bulb," which includes one or more power supplies to power the LEDs. An LED bulb may be made with a form factor that allows it to replace a standard threaded incandescent bulb, or any of various types of fluorescent lamps.

Since, ideally, an LED bulb designed as a replacement for a traditional light source needs to be self-contained, the power supply and the LED package or packages are often near each other. Although LED bulbs typically include a heat sink, the heat generated by the LEDs can raise the temperature of the power supply components, and the resulting temperature increase must be taken into account in the power supply design.

SUMMARY

Embodiments of the present invention provide for thermal isolation between the power supply and the LED assembly of an LED lamp, in most cases allowing the power supply for the lamp to operate in a lower temperature range than would otherwise be possible. In some embodiments, a thermal isolation device is used to maintain a thermal transfer gap or thermal transfer gaps between the power supply and the LED assembly, reducing the amount of direct thermal interaction between the two. Thus, a separate heat dissipation solution can be implemented for the LED assembly and the power supply, providing for greater design flexibility with respect to the lamp.

In some embodiments, an LED lamp includes at least one LED assembly and a power supply electrically connected to the LED assembly. At least one contact feature is provided between the power supply and the LED assembly to maintain a thermal transfer gap between the power supply and the LED assembly. In some embodiments the LED lamp includes an Edison base connected to the power supply. In some embodiments, the LED lamp includes an optical element disposed to emit light from the LED lamp. In some embodiments, a second optical element can be used, and the second optical element can be treated with phosphor.

In some embodiments, the thermal transfer gap is maintained by a thermal isolation device installed between the LED assembly and the power supply. In some embodiments, the thermal isolation device includes first and second faces, wherein each face is disposed to be proximate to either the power supply or the LED assembly for the lamp. The contact feature or a plurality of contact features are formed on or connected to one or both of the first and second faces of the thermal isolation device. In some embodiments, the contact feature comprises a triangular ridge. In some embodiments, the contact feature comprises a conical protrusion.

In some embodiments a thermal isolation device can include an attachment mechanism or attachment mechanisms to fix the thermal isolation device to the power supply portion or the LED assembly portion of the lamp, or to both. For example, the attachment mechanism can be protruding tabs, slots for receiving protruding tabs, or a combination of the two. Note that the thermal isolation device being "fixed" to a particular portion of the lamp does not necessarily mean it is directly attached to any particular component such as the power supply or an LED assembly. For example, the thermal isolation device could attach to a heat sink which is part of, or simply connected to the LED assembly portion of the lamp. The connection between the thermal isolation device and any particular portion of the LED lamp may be indirect.

An LED lamp according to example embodiments of the invention can be produced by assembling a power supply portion of the LED lamp and an LED assembly portion of the LED lamp. The thermal isolation device including at least one contact feature disposed to maintain the thermal transfer gap is also formed. The power supply portion, the thermal isolation device and the LED assembly portion of the LED lamp are then interconnected so that at least one thermal transfer gap is maintained between the power supply portion and the LED assembly portion of the LED lamp. In at least some embodiments an optical element is installed on the lamp. In some embodiments, an Edison base is provided for the power supply. In accordance with other embodiments of the present invention, the various portions of the lamp, such as the LED assembly, the power supply, a thermal isolation device and others can take the form of connectable or fastenable modules that can be interconnected to form a modular LED lamp.

BRIEF DESCRIPTION OF THE DRAWINGS

FIG. 2 is presented in various views as FIGS. 2A, 2B, 2C and 2D.

FIG. 5 is presented in a perspective view designated as FIG. 5A and a partial cross-section view designated as FIG. 5B.

DETAILED DESCRIPTION

The following detailed description refers to the accompanying drawings, which illustrate specific embodiments of the invention. Other embodiments having different structures and operation do not depart from the scope of the present invention.

Embodiments of the invention are described with reference to drawings included herewith. Like reference numbers refer to like structures throughout. It should be noted that the drawings are schematic in nature. Not all parts are always shown to scale. The drawings illustrate but a few specific embodiments of the invention.

Figure 1:
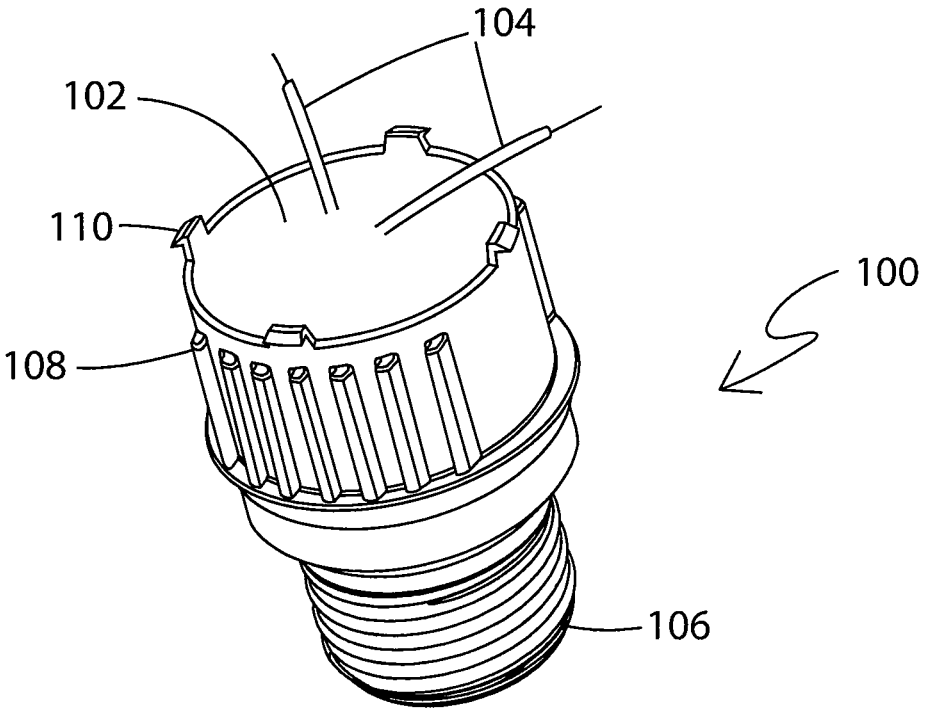
FIG. 1 is a perspective illustration of a power supply portion of an LED lamp according to example embodiments of the present invention.
Figure 2A:
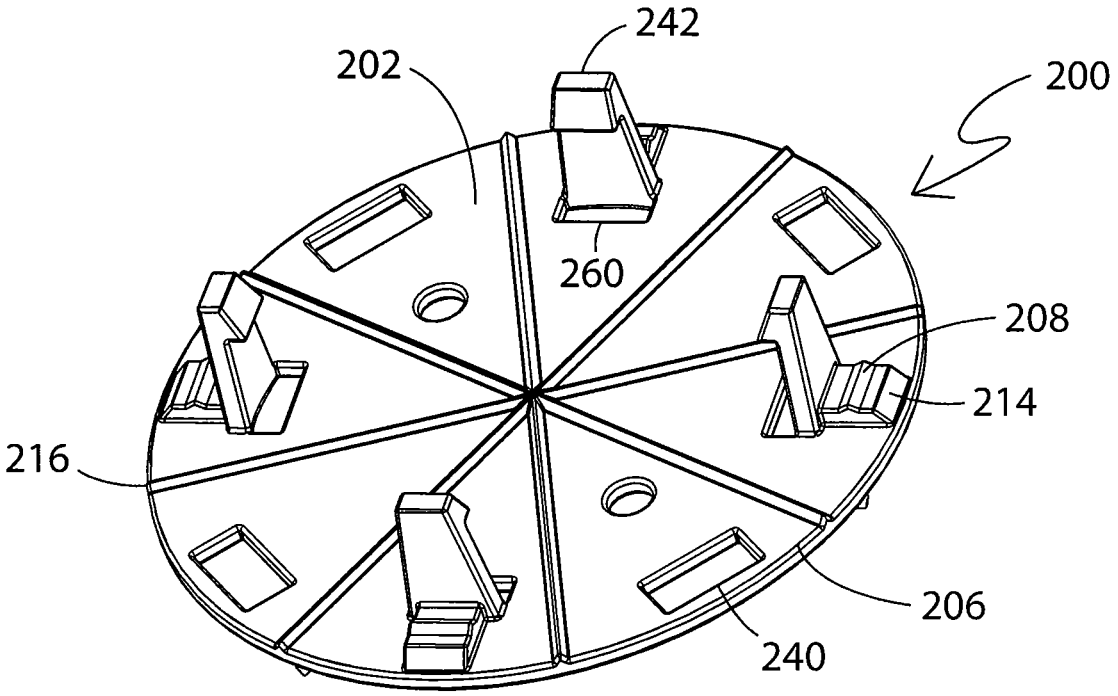
FIG. 2 illustrates a thermal isolation device according to some embodiments of the present invention.
Figure 2B:
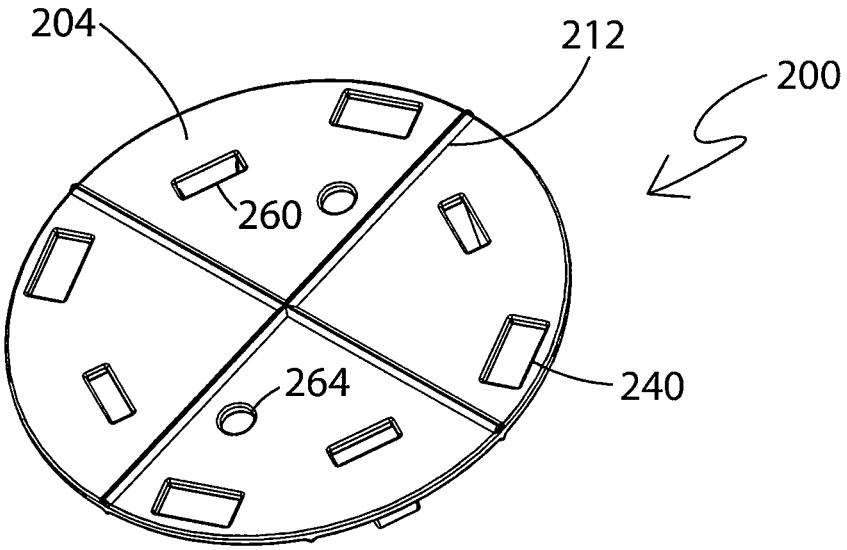
Figure 2C:
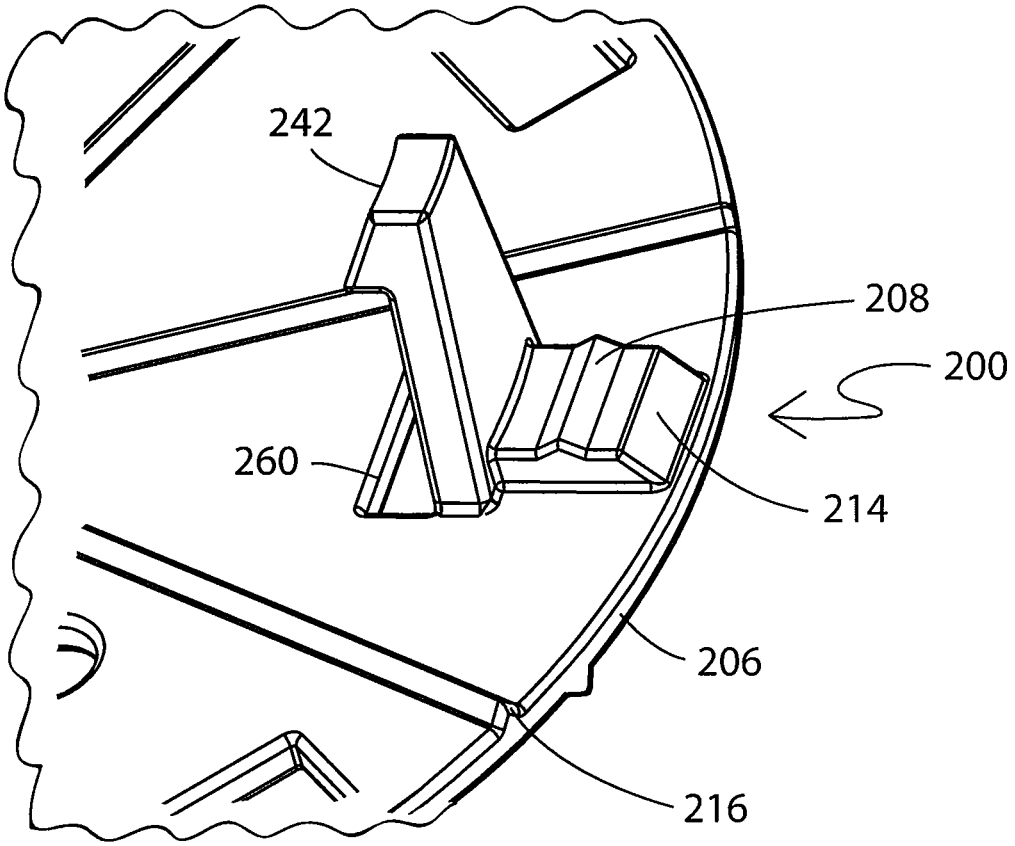
Figure 2D:
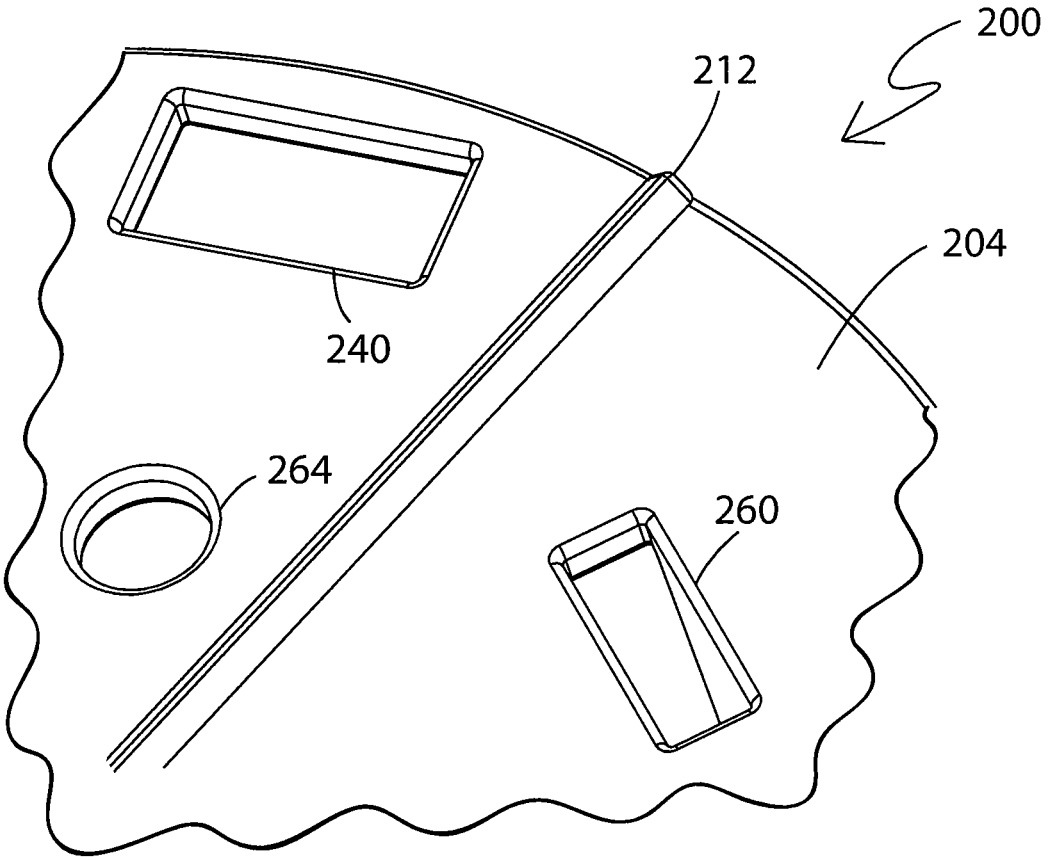

FIG. 1 shows the power supply portion 100 of an LED lamp according to example embodiments of the invention.

The power supply portion 100 of the lamp includes a power supply consisting of circuitry (not visible) to provide DC current to an LED assembly. To assemble the power supply portion of the lamp, the circuitry is installed within the void in the power supply portion and potted, or covered with a resin to provide mechanical and thermal stability. The potting material fills the space within power supply portion 100 not occupied by power supply components and connecting wires. The top surface of the set potting material is visible in this perspective view. Wires 104 protrude from the potting material. These wires connect to the LED assembly of the finished lamp and supply power to the LED modules n the assembly.

The particular power supply portion of an LED lamp shown in FIG. 1 includes an Edison base, 106 and cooling vents 108, which direct heat out of the power supply. The Edison base can engage with an Edison socket so that this example LED lamp can replace a standard incandescent bulb. The electrical terminals of the Edison base are connected to the power supply to provide AC power to the power supply. This power supply portion of the lamp also includes tabs 110 to engage the thermal insulation device described below. The particular physical appearance of the power supply portion and type of base included are examples only. Numerous types of LED lamps can be created using embodiment of the invention, with various types of bases, cooling mechanisms and shapes.

FIG. 2 shows a thermal isolation device 200 according to example embodiments of the invention. The device is illustrated in perspective views shown in FIGS. 2A and 2B from different viewpoints, as well as magnified view of the edge of each face of the device shown in FIGS. 2C and 2D. Thermal isolation device 200 includes a first face 202 and a second face 204. The device is substantially disk shaped and has a circumferential edge 206 that is roughly coincident with the outside of the LED lamp power supply portion when installed. In this example, the first face is intended to be proximate to the LED assembly of the lamp, and the second face is intended to be proximate to the power supply of the lamp; however, the designations of the first face and the second face are arbitrary. An isolation device according to example embodiments of the invention can vary in size, shape and thickness. The isolation device can be sized and shaped in accordance with the profile of the other lamp components. In the embodiments disclosed here, it is disc-shaped and sized to match the outer diameter of the power supply portion of the lamp. The radius in such a case could be from 15 to 20 mm and in one example is about 18.5 mm. In addition to a disc (round) shape, the isolation device could be square, rectangular, oval, or irregularly shaped. The thickness can vary as needed. The thickness could vary from about 0.25 mm to 5 or even 10 mm. In one example, the main portion of the thermal isolation device is about 1 mm thick from face to face.

Still referring to FIG. 2, the example thermal insulation device includes contact features 208 on the first face and contact features 212 on the second face of the device. The contact features in this example are triangular ridges and are designed to minimize the contact area and maintain a thermal transfer gap between the device and the other portions of the lamp. Thus, the device effectively maintains two thermal transfer gaps between the power supply and the LED assembly of the LED lamp once the lamp is assembled. Note that in this example the triangular ridges 208 on the first face are further on top of raised pedestals 214; however, for purposes of the terminology of this disclosure, they can still be considered to be on the first face of the thermal transfer device. Other intervening structures could also be included between any of the contact features and a face of the thermal transfer device in other embodiments.

It cannot be overemphasized that the thermal insulation device of FIG. 2 is an example only, and a thermal insulation device according to an embodiment of the invention can be made in various ways. A thermal isolation device in the context of embodiments of the invention can be any device designed to reduce the flow of thermal energy between different components by imparting an air gap or, or by interfering with thermal transfer between components.

With a thermal isolation device as illustrated in FIG. 2, any number of contact features can be included in either or both faces and the contact features can be distributed over the device in various ways. It should be noted that other triangular ridges, 216, are included in the first face of the thermal transfer device. In this particular embodiment, these additional ridges 216 are not contact features for thermal purposes but rather provide mechanical strengthening for the device. The contact features can be of various dimensions, depending on the size of thermal isolation gap desired and regardless of whether the contact features are included on a separate thermal isolation device or directly on other components of the lamp. In some embodiments, the combined height of the contact feature and the pedestal on the first face of the thermal isolation device is about 1.4 mm. The combined height of the pedestals and contact features in some embodiments can range from 0.5 to 10 mm, with contact features on the thermal isolation device ranging in height from 0.1 mm to 5 mm. In at least one embodiment, the height of the contact features on the thermal isolation device is about 0.25 mm.

Continuing with FIG. 2, thermal isolation device 200 in this example includes at least one attachment mechanism. In this particular embodiment, the device includes multiple attachment mechanism in the form of slots 240 and protruding tabs 242. The protruding tabs in this example engage slots in the LED assembly portion of the lamp, as will be later discussed, and the holes engage tabs 110 on the power supply portion of the lamp. Thermal insulation device 200 includes additional rectangular holes 260 which allow the protruding tabs 242 to flex without significant strain. Additionally, the device in this embodiment includes circular holes 264 through which the wires running between the power supply and the LED modules are passed. These wires were shown in FIG. 1 as wires 104.

Figure 3:
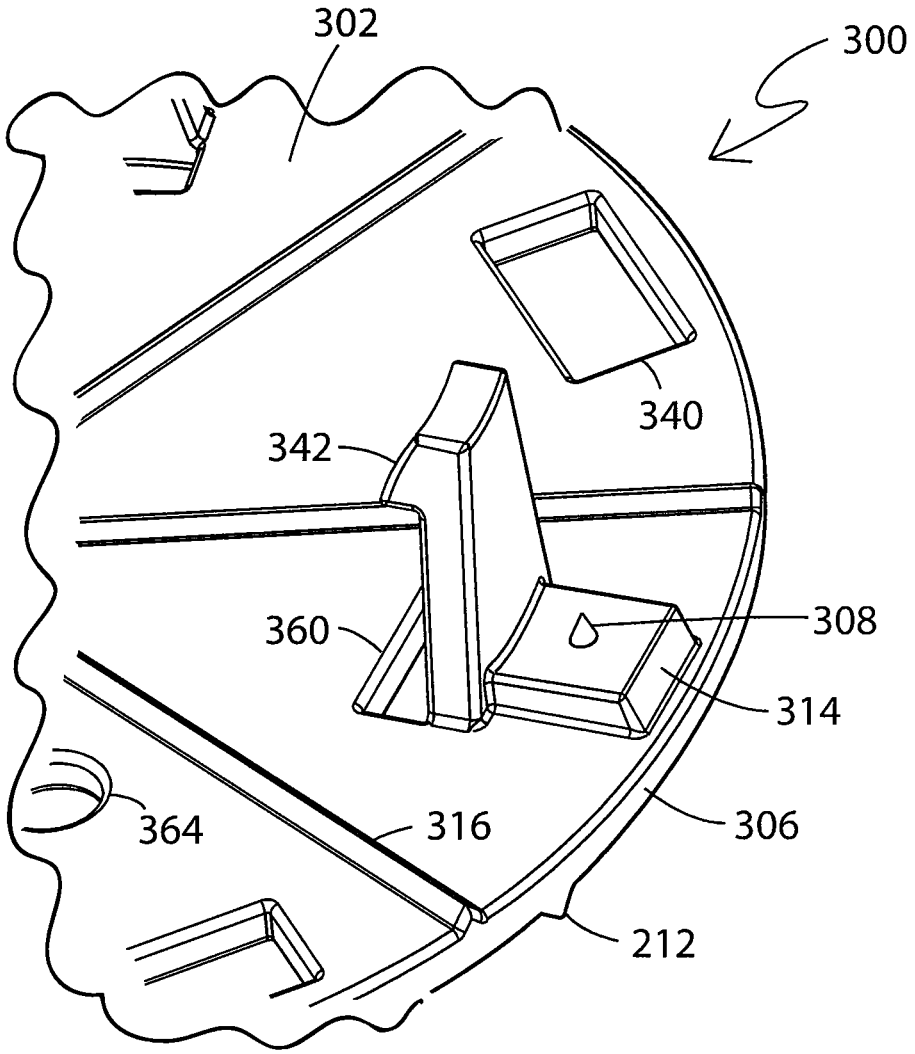
FIG. 3 illustrates a portion of a thermal isolation device according to another embodiment of the present invention.

FIG. 3 is another example embodiment of a thermal isolation device. Since the device of FIG. 3 is the same as the device in FIG. 2 in many respects, only one view is shown. Thermal isolation device 300 includes a first face 302 and a second face (not visible). The device has a circumferential edge 306. Thermal isolation device 300 of FIG. 3 again includes contact features to provide for at least one thermal isolation gap. However in this case, at least some of the contact features are conical protrusions such as conical protrusion 308. Any number of these conical protrusions can be included, or a mix of conical protrusions and triangular ridges can be included as contact features. Contact features can also take other shapes. In this example, triangular ridges 312 are positioned on the second face of the device as contact features. Triangular ridges 316 are included in the first face of the thermal transfer device to provide mechanical strengthening for the device.

Still referring to FIG. 3, thermal isolation device 300 as before includes attachment mechanisms in the form of slots 340 and protruding tabs 342. The protruding tabs in this example engage slots in the LED assembly portion of the lamp, and the holes engage the tabs on the power supply portion of the lamp. Thermal isolation device 300 includes additional rectangular holes 360 which allow the protruding tabs 342 to flex without significant strain. The device in this embodiment also includes circular holes 364 through which the wires running between the power supply and the LED modules are passed.

Embodiments of the thermal isolation device can use varied fastening methods and mechanisms. For example, in some embodiments a part or a peg with a groove or ridge can snap into a corresponding hole. In some embodiments, combinations of fasteners such as tabs, latches or other suitable fastening arrangements and combinations of fasteners can be used which would not require adhesives or screws. In other embodiments, adhesives, screws, or other fasteners may be used.

Figure 4:
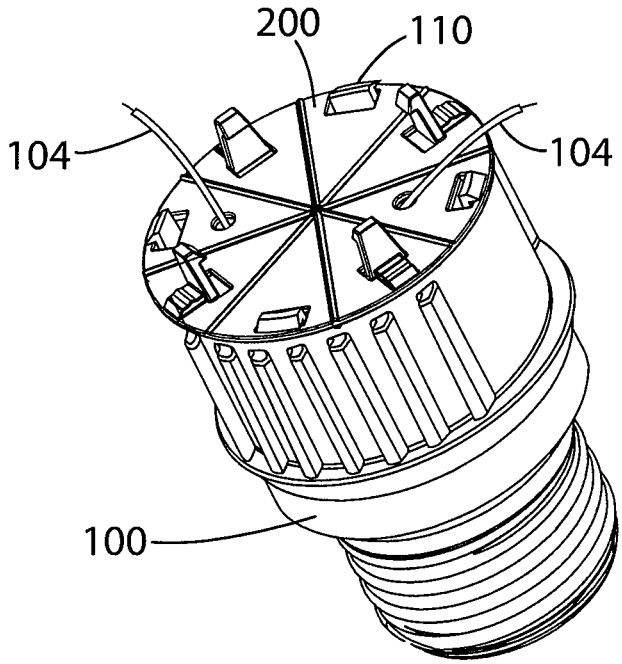
FIG. 4 is a perspective illustration of a power supply assembly of an LED lamp with a thermal isolation device attached according to some embodiments of the invention.

FIG. 4 is a perspective view of a partially assembled LED lamp according to example embodiments of the invention. In FIG. 4, the power supply portion 100 of the LED lamp and thermal isolation device 200 of the LED lamp have been interconnected so that the thermal isolation device is fixed to the power supply portion with the provided attachment mechanisms. Tabs 110 of the power supply portion 100 engage the slots on the thermal isolation device. The wires 104 to electrically interconnect the power supply to the LEDs in the lamp can be seen protruding through the holes in the thermal isolation device.

Figure 5A:
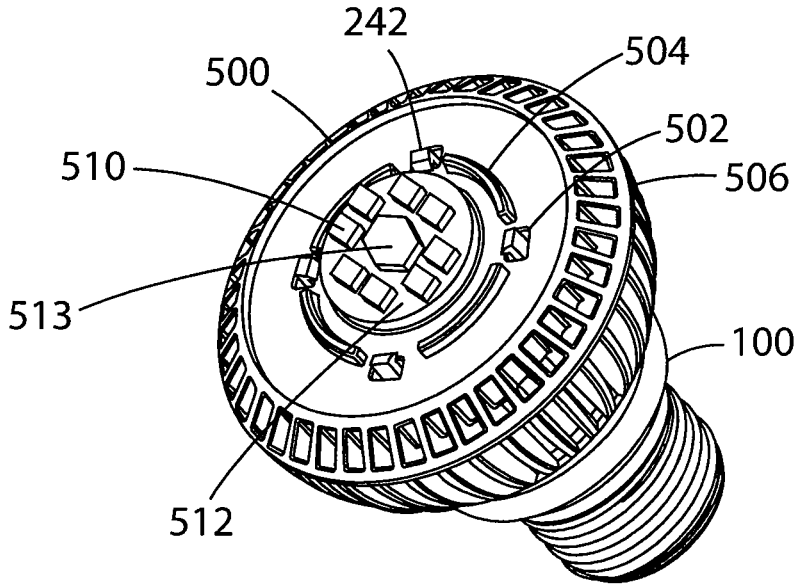
FIG. 5 is an illustration of an example LED lamp including a power supply portion, an LED assembly and a thermal isolation device.
Figure 5B:
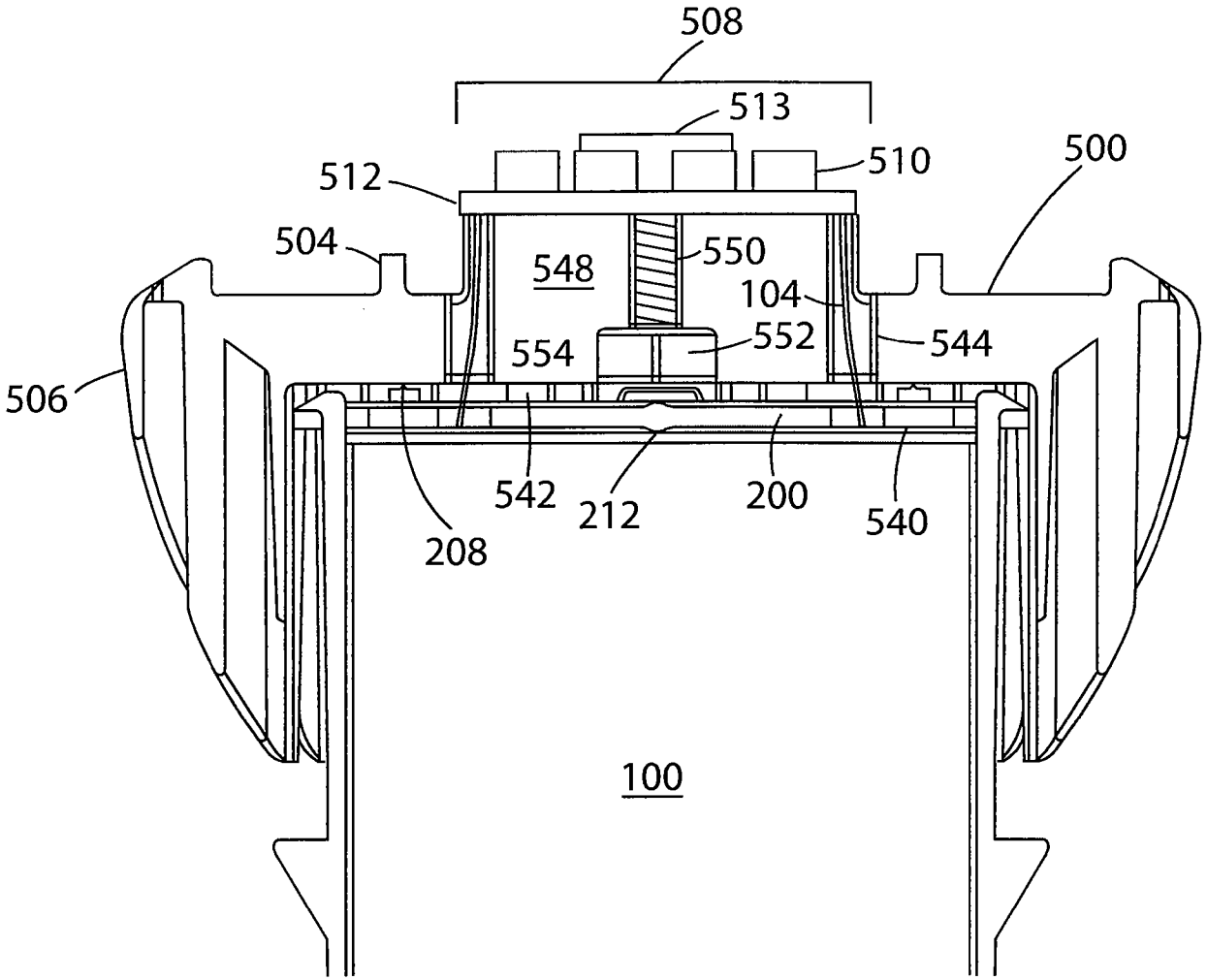

FIG. 5 shows two views of the partially assembled lamp according to embodiments of the invention. FIG. 5A is a perspective view and FIG. 5B is a side view shown in as a partial cross section. In the case of FIG. 5, LED assembly portion of the lamp, 500, has been interconnected with the thermal isolation device, which is in turn interconnected with power supply portion 100 of the lamp. Tabs 242 of the thermal isolation device engage corresponding slots 502 in the LED assembly portion of the lamp. Curved ridges 504 provide additional mechanical stability to the LED assembly portion, and may define a space in which an optical element or optical elements for the lamp can rest. LED assembly portion 500 includes heat sink 506 and LED assembly 508. The LED assembly further includes multiple LED modules 510 mounted on a support such as circuit board 512, which provides both mechanical support and electrical connections for the LEDs. The illustrated portions of the lamp are held together in part by bolt 513. It should be noted that the heat sink design can vary. A heat sink may be used that has more extended curved fins, more or fewer fins, etc. A heat sink may be provided that has a more decorative appearance.

Still referring to FIG. 5, especially FIG. 5B, a number of details of the arrangement of interconnected components of the lamp are visible. Thermal isolation device 200 can be seen, with contact features 208 and 212 visible. These contact features maintain two thermal transfer gaps in this example embodiment of the lamp. Thermal transfer gap 540 is a relatively narrow thermal transfer gap between the power supply and the thermal isolation device, while wider thermal transfer gap 542 is maintained between the LED assembly portion of the lamp and the thermal isolation device. Wires 104 can be seen passing through thermal transfer gap 542 and voids 544. These wires have been trimmed and connected to the LED assembly to provide power to the LED modules 510. Supporting structure 548 of the LED assembly portion of the lamp includes void 550 through which bolt 513 passes, to be secured by nut 552 which rests in formed recess 554. A lock washer (not visible) may be further included within this recess, or at the head of bolt 513, or a "self-locking" nut and bolt set could be used to securely hold the LED assembly portion of the lamp together.

It should be noted that the particular shape of the contact features used to create a thermal isolation gap can be chosen to minimize direct mechanical contact between the components. In the present example, the contact features substantially come to a narrow, almost pointed ridge. In another example, conical contact features substantially come to a point. This same principle applies whether or not a separate thermal isolation device is used, as similar contact features could be placed directly on the other lamp components or assemblies to maintain thermal isolation between the LED assembly and the power supply portion of a lamp without the use of a separate thermal isolation device.

Figure 6:
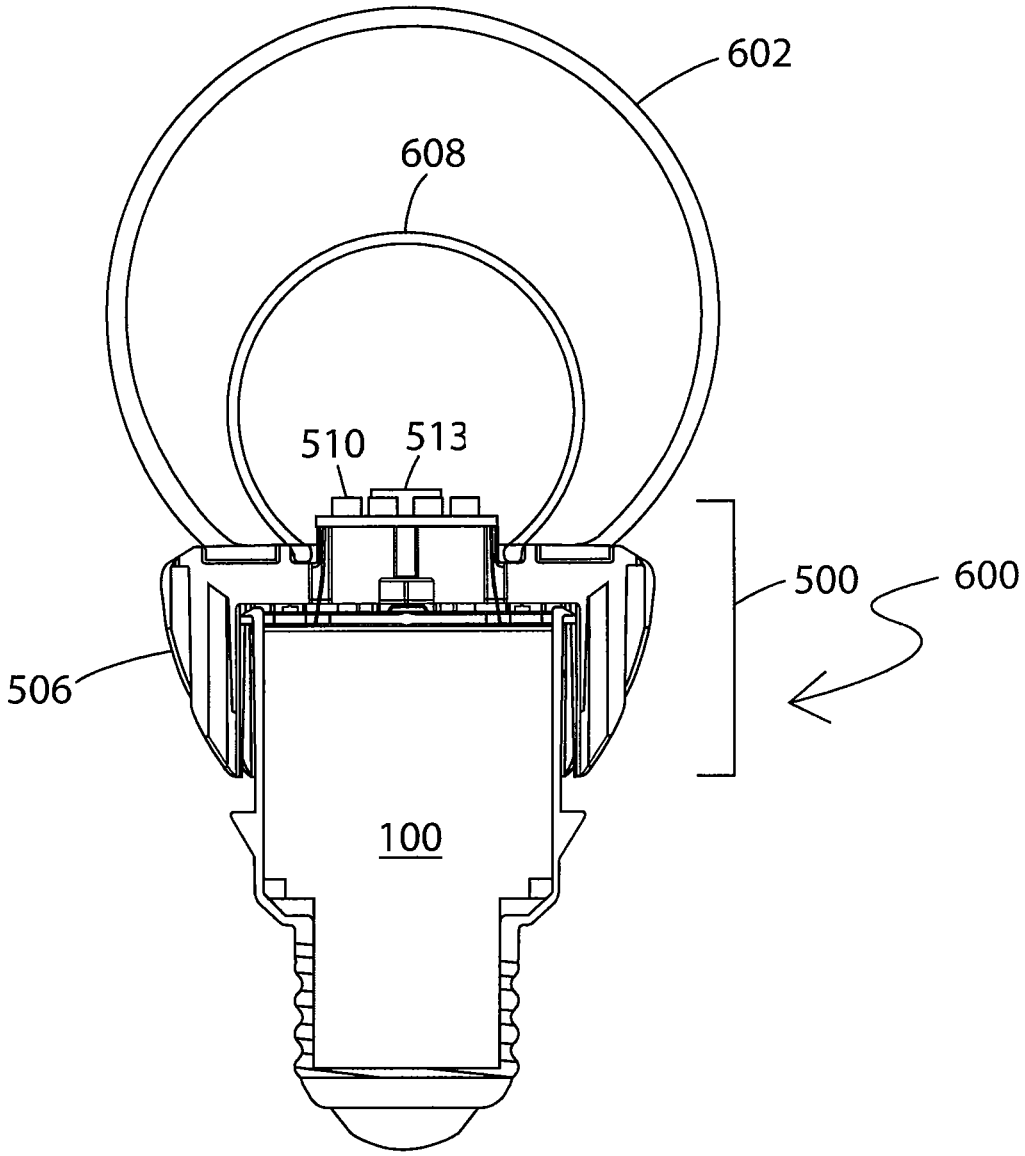
FIG. 6 is a cross-sectional view of an LED lamp according to at least some embodiments of the present invention.

FIG. 6 is a cross-sectional view of a finished LED lamp according to example embodiments of the present invention. Lamp 600 of FIG. 6 includes LED assembly portion 500 and power supply portion 100 as previously described. Lamp 600 includes optical element 602 to protect the LED modules and provide additional direction, diffusion, color mixing or conversion of the light from the LEDs as will be further described below. Optical element 602, in this embodiment essentially a light transmissive globe, is fixed to the LED assembly of the lamp.

The various portions of the LED lamp according to example embodiments of the invention can be made of any of various materials. The heat sink can be made of metal or plastic, as can the various portions of the housings for the components of the lamp. Plastic with enhanced thermal conductivity can be used to form the heat sink. The thermal isolation device can be made of various materials including those that resist thermal transfer such as thermally insulating plastics and polymers. The optical element can be made of glass or plastic or any other suitable optical material.

In the example embodiments shown in the figures herein, air naturally fills the thermal isolation gap and provides adequate thermal isolation. Additional thermal isolation can be obtained with various treatments of the gap. For example, gaskets could be provided to seal the gap and it could be evacuated, providing additional isolation. A sealed gap could also be filled with a gas that provides better thermal isolation properties than air. Also, the gap would be filled with thermally insulating material by way of a resin or potting compound that does not conduct heat well. Films or sheets of thermally insulating material could also be placed in the thermal transfer gap. Examples of such material include Formex™ manufactured by Formex Manufacturing, Inc. and Nomex™ manufactured by E.I. du Pont de Nemours Company.

Since LED chips typically emit light of a single color or wavelength, it is often desirable to mix multiple LED chips, each emitting a different color of light within a device or within a lamp such as lamp 600 of FIG. 6. As an example, devices emitting red, green and blue (RGB) light can be used to form substantially white light. As another example, red and blue-shifted yellow (R+BSY) devices might be used together to create substantially white light. In some embodiments, each LED module 510 of FIGS. 5 and 6 will contain multiple LEDs to provide white light. It is also possible to create white light by using multiple modules in the lamp, each emitting one or two colors of light. Since the different color-emitting LED chips in such examples must necessarily be separated in space, even if by very tiny amounts, it may be desirable to add color mixing treatment to the lamp. This color mixing treatment can eliminate any color tint that may otherwise appear in parts of the light pattern from the lamp.

Color mixing treatment can consist of or include frosting, texturing or lens shaping of a portion of the LED module packaging, the optical element 602 of FIG. 6, or both. Additional material could also be added to the void inside the optical element to serve as color mixing treatment.

It should be noted that as an alternative to producing white light by using LED chips that emit different colors and color mixing treatment, an LED lamp according to embodiments of the invention can be designed to use phosphor to emit substantially white light. With such a lamp, single-color LED devices would be used, for example, blue, violet, or ultraviolet emitting LED chips. The lamp's optical element, 602 of FIG. 6, in such a case can be made of a material that is treated or coated with phosphor that emits substantially white light when energized by the light from the LEDs. Alternatively, an additional optical element can be installed inside an external globe and that additional optical element can be treated or coated with phosphor.

Referring again to FIG. 6, an additional, phosphor coated optical element 608 is shown. A lamp like that shown in FIG. 6 can be made with or without the phosphor coated globe 608 depending on what type of LEDs are used and the light pattern desired. In these examples both optical elements include a lip that rests in the spaces on one side or the other of ridge 504 in the top of the lamp. An optical element can then be fastened in place with thermal epoxy. Other fastening methods can be used to fasten an optical element to the other parts of the lamp. As examples, globes can be threaded and can screw into or onto the rest of the lamp. A tab and slot or similar mechanical arrangement could be used, as could fasteners such as screws or clips.

As has been noted above, optical elements can be used in various configurations with illustrative embodiments of the lamp described herein. Also, as previously noted, various types of heat sinks and thermal isolation devices could be used with the lamp. These characteristics of embodiments of the present invention underscore the modular nature of an LED lamp and the thermal isolation device as described herein. In some embodiments, each of the thermal isolation device, the power supply portion, the optical element(s), and LED assembly portion of the lamp work as independent modules or subassemblies that can be put together into a finished lamp. In some such modular designs, some portions of the modular LED lamp can be broken down further into additional independent modules. For example, the LED assembly portion can be broken down into a heat sink and an LED assembly. In some embodiments, the heat sink may not be part of the LED assembly module, but may rather be an independent module for the modular lamp.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. Additionally, comparative, quantitative terms such as "less" and "greater", are intended to encompass the concept of equality, thus, "less" can mean not only "less" in the strictest mathematical sense, but also, "less than or equal to."

It should also be pointed out that references may be made throughout this disclosure to figures and descriptions using terms such as "top", "side", "within", "beside", "on", and other terms which imply a relative position of a structure, portion or view. These terms are used merely for convenience and refer only to the relative position of features as shown from the perspective of the reader. An element that is placed or disposed atop another element in the context of this disclosure can be functionally in the same place in an actual product but be beside or below the other element relative to an observer due to the orientation of a device or equipment. Any discussions which use these terms are meant to encompass various possibilities for orientation and placement.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. An LED lamp comprising:

an LED assembly including a first plurality of slots;

a power supply portion electrically connected to the LED assembly, the power supply portion including a first plurality of tabs; and a thermal isolation device further comprising:

a first face including a second plurality of tabs that engages the first plurality of slots with the first face proximate to the LED assembly;

a second face proximate to the power supply portion;

a second plurality of slots to engage the first plurality of tabs; and wherein contact features are arranged on the first face and the second face of the thermal isolation device to maintain one thermal transfer gap between the power supply portion and the second face of the thermal isolation device and another thermal transfer gap between the LED assembly and the first face of the thermal isolation device wherein the thermal transfer gap between the power supply portion and the second face measures from 0.1 mm to 5 mm.

2. The LED lamp of claim 1 wherein at least some of the contact features comprise a triangular ridge.

3. The LED lamp of claim 2 wherein at least some of the contact features comprise a plurality of triangular ridges distributed on at least one face of the thermal isolation device.

4. The LED lamp of claim 2 further comprising an Edison base connected to the power supply.

5. The LED lamp of claim 4 further comprising an optical element disposed to emit light from the LED lamp.

6. The LED lamp of claim 1 wherein at least some of the contact features comprise a conical protrusion.

7. The LED lamp of claim 6 wherein at least some of the contact features comprise a plurality of conical protrusions distributed on at least one face of the thermal isolation device.

8. The LED lamp of claim 1 further comprising an Edison base connected to the power supply.

9. The LED lamp of claim 8 further comprising an optical element disposed to emit light from the LED lamp.

10. The LED lamp of claim 9 further comprising an additional optical element that has been treated with phosphor.

11. A method of producing an LED lamp, the method comprising:

assembling a power supply portion of the LED lamp and an LED assembly portion of the LED lamp, the LED assembly portion including a first plurality of slots, and the power supply portion including a first plurality of tabs;

providing a thermal isolation device having a radius from about 15 mm to about 20 mm comprising at least two contact features on a first face of the thermal isolation device and at least two contact features on a second face of the thermal isolation device disposed to maintain two thermal transfer gaps, one thermal transfer gap between the LED assembly portion and the first face of the thermal isolation device and another thermal transfer gap between the power supply portion and the second face of the thermal isolation device, wherein the thermal isolation device also includes a second plurality of slots in the thermal isolation device and second plurality of tabs on the first face of the thermal isolation device; and interconnecting the power supply portion, the thermal isolation device and the LED assembly portion by engaging the second plurality of tabs with the first plurality of slots and the second plurality of slots with the first plurality of tabs so that the two thermal transfer gaps are maintained.

12. The method of claim 11 further comprising installing an optical element proximate to the LED assembly portion to emit light from the LED lamp.

13. The method of claim 12 wherein at least some of the contact features comprise a plurality of triangular ridges distributed on the thermal isolation device.

14. The method of claim 13 wherein the power supply portion comprises an Edison base.

15. The method of claim 12 wherein at least some of the contact features comprise a plurality of conical protrusions distributed on the thermal isolation device.

16. The method of claim 15 wherein the power supply portion comprises an Edison base.

17. A modular LED lamp comprising:

an LED assembly module including one of a first plurality of slots and a first plurality of tabs;

a power supply module including the other of the first plurality of slots and the first plurality of tabs; and a thermal isolation device disposed to maintain one thermal isolation gap between the LED assembly module and a first face of the thermal isolation device and another thermal isolation gap between a second face of the thermal isolation device and the power supply module, wherein the thermal isolation device further includes a second plurality of tabs that engages the first plurality of slots and a second plurality of slots that engages the first plurality of tabs.

18. The modular LED lamp of claim 17 further comprising a heat sink disposed to cool an LED assembly.

19. The modular LED lamp of claim 18 further comprising at least a first optical element disposed to emit light from the LED lamp.

20. The modular LED lamp of claim 19 further comprising a second optical element.

21. The modular LED lamp of claim 20 wherein at least one of the first and second optical elements is treated with phosphor.

22. The modular LED lamp of claim 17 further comprising contact features arranged on the first face and the second face of the thermal isolation device.

23. The modular LED lamp of claim 22 wherein at least some of the contact features comprise a triangular ridge.

24. The modular LED lamp of claim 23 wherein at least some of the contact features comprise a plurality of triangular ridges distributed on at least one face of the thermal isolation device.

25. The modular LED lamp of claim 22 wherein at least some of the contact features comprise a conical protrusion.

26. The modular LED lamp of claim 25 wherein at least some of the contact features comprise a plurality of conical protrusions distributed on at least one face of the thermal isolation device.

* * * * *